US005635909A

United States Patent [19]

Cole

[11] Patent Number: 5,635,909

[45] Date of Patent: Jun. 3, 1997

[54] TEMPERATURE MONITORING ASSEMBLY INCORPORATED INTO A PROTECTIVE GARMENT

[76] Inventor: Boyd F. Cole, 1006 Mayfair Dr., Libertyville, Ill. 60048

[21] Appl. No.: 56,375

[22] Filed: Apr. 30, 1993

Related U.S. Application Data

[63] Continuation-in-part of Ser. No. 941,514, Sep. 8, 1992, abandoned.

[51] Int. Cl.[6] ..... G08B 17/00

[52] U.S. Cl. ..... 340/586; 2/93; 340/693

[58] Field of Search ..... 340/584, 586, 340/573, 693; 2/2, 2.5, 5, 7, 8

[56] References Cited

U.S. PATENT DOCUMENTS

| | | | |
|---|---|---|---|
| 3,201,771 | 8/1965 | Proulx | 340/586 |
| 4,914,422 | 4/1990 | Rosenfield et al. | 340/586 X |
| 4,988,884 | 1/1991 | Dunbar et al. | 340/578 X |
| 5,157,378 | 10/1992 | Stumberg | 340/586 X |
| 5,200,736 | 4/1993 | Coombs et al. | 340/586 |

*Primary Examiner*—Thomas Mullen

*Attorney, Agent, or Firm*—Dressler, Rockey, Milnamow & Katz, Ltd.

[57] ABSTRACT

A temperature sensing circuit, a temperature sensor and a speaker are incorporated in a protective garment having an exterior heat resistant shell and an interior lining to provide a garment that can indicate that the exterior heat resistant shell has exceeded a predetermined temperature limit.

10 Claims, 2 Drawing Sheets

TEMPERATURE MONITORING ASSEMBLY INCORPORATED INTO A PROTECTIVE GARMENT

CROSS REFERENCE TO RELATED APPLICATION

This application is a continuation-in-part of U.S. Ser. No. 07/941,514 filed Sep. 8, 1992 now abandoned. The subject matter of the foregoing application is fully incorporated herein by reference.

FIELD OF THE INVENTION

The present invention relates to a temperature monitoring circuit incorporated into a protective garment, such as a fire fighter's turnout coat and is a continuation-in-part application.

BACKGROUND OF THE INVENTION

For many years protective garments have been worn by people for the purpose of protection from a harsh or dangerous environment. One example of such a protective garment is a firefighter's turnout coat. While these protective garments have become proficient at insulating the wearer from the potentially hazardous environment, such garments have also reduced the wearer's ability to sense changing conditions of the environment. In the past, firefighters detected extreme temperatures with their earlobes, which were the only part of the body exposed to the atmosphere. Unfortunately, the protective clothing now required to be worn by firemen including turnout coats, hoods, helmets, and boots, cover the entire body, leaving no bodily means of detecting extreme temperatures.

To help reduce the risk of severe bums, U.S. Pat. No. 3,201,771 discloses a firefighters' helmet having a plurality of thermostatic elements distributed about the helmet. The thermostatic elements are connected to an electrical circuit and the elements cause the electrical circuit to sound a warning horn in a dangerous heat environment. The patent also discloses that the warning system of the helmet may be activated manually in a situation where the firefighter becomes disoriented in a burning structure. The drawback of such a firefighter's helmet is that the thermostatic elements and electrical circuit including the power supply are mounted on the exterior of the helmet. This location makes the helmet heavy and awkward to wear. This location also exposes the electrical circuit to the same high ambient and radiant temperatures as the sensors, thus creating a greater likelihood of electronic failure than if it were located in an insulated environment. The location of the electrical circuit also subjects the circuit to a greater risk of failure caused by debris falling on the helmet. In addition, such a temperature sensing device does not detect radiant heat. U.S. Pat. No. 4,914,422 discloses a personal alert safety system (PASS) which attaches to a firefighter's shoulder harness. The system audibly indicates temperature changes in 100° F. increments within a hazardous environment. The system also includes a motion sensor which audibly indicates lack of motion after a period of time. Because the system is mounted externally on a firefighter's shoulder strap, the electronics of the unit are exposed to the same high ambient and radiant temperatures as the electronics of the helmet warning system described above. Also, the external location of the electronic unit increases the risk of electronic component damage of failure caused by falling debris, or can snag on an obstruction where it can be damaged, and/or compromise the firefighter's movement.

The present invention greatly improves the reliability of prior art warning systems by incorporating a thermal warning circuit within a protective garment such as a firefighters' turnout coat. The system provides the garment wearer with a reliable audible alarm when dangerous high temperature conditions exist such as when ambient and radiant heat from a burning structure are conducive to flashover (where the entire room suddenly ignites) or where such excessive radiant heat can cause the temperature of the firefighter's protective clothing to increase so as to cause it to disintegrate, potentially placing firefighters at risk of death or receiving severe burns.

SUMMARY OF THE INVENTION

The present invention relates to a protective garment for protecting a wearer from exposure to a high temperature environment and for warning the wearer of a potentially dangerous high temperature exposure. The protective garment comprises an exterior heat resistant shell, and an interior lining. The interior lining is fitted with an electronic temperature sensing circuit. The electronic temperature sensing circuit includes at least one input and at least one output, and further includes at least one logic circuit means connected between the input and the output. The logic circuit means is configured to determine if the input has exceeded a predetermined limit and to cause a signal to be sent to the output when the logic circuit has determined that the input has exceeded the predetermined limit.

The garment also includes at least one electronic temperature sensing means positioned between the exterior heat resistant shell and interior lining. The temperature sensing means is electrically connected to the input of the electronic temperature sensing circuit. The garment further includes at least one audible alerting means. The audible alerting means is electrically connected to the output of the electronic temperature sensing circuit.

One objective of the present invention is to provide a protective garment which has a reliable high temperature warning alarm for firefighters and other professionals working in a potentially dangerous high temperature environment.

Another objective is to provide a protective garment having an electronic high temperature alarm circuit wherein all of the electrical components are insulated from damaging high temperatures by being located inside the garment's heat-insulating shell.

Other objectives and advantages of the present invention will become apparent to those skilled in the art from the following detailed description read in conjunction with the attached drawings and claim appended hereto.

DETAILED DESCRIPTION OF THE INVENTION

Figure 1:
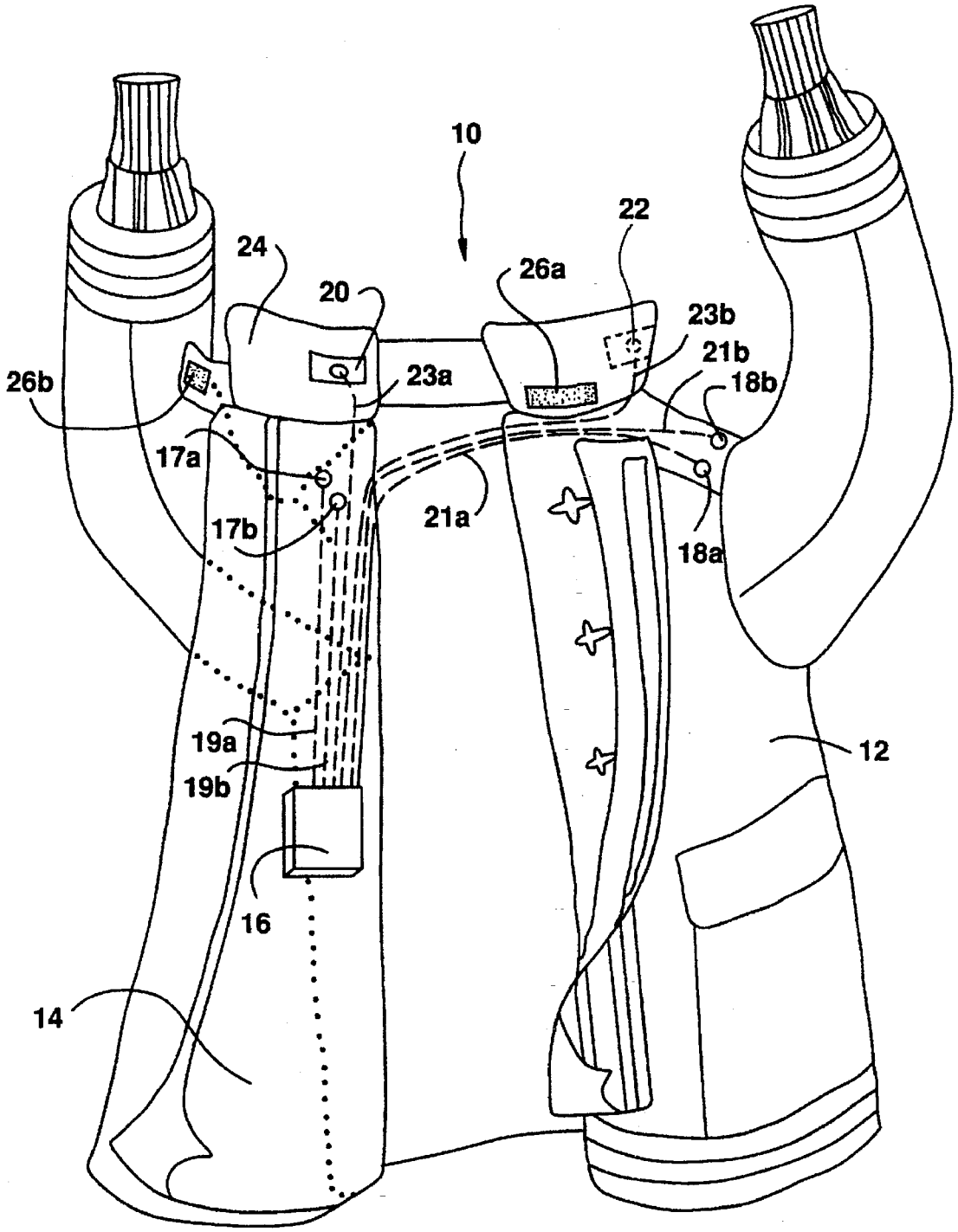
FIG. 1 is a diagrammatic perspective view of a firefighter's turnout coat which is one contemplated embodiment of the present invention.

The present invention relates to a protective garment having an electronic temperature sensing circuit incorporated therein. FIG. 1 illustrates a firefighting turnout coat embodiment of the present invention. While a firefighting turnout coat is illustrated for the purpose of explaining the present invention, those skilled in the art will appreciate that the present invention may be practiced on a wide variety of protective garments including overalls, vests, and one piece coveralls.

Referring to FIG. 1, firefighting turnout coat 10 is shown opened so as to display an exterior heat resistant shell 12 made from Nomex™, a fabric manufactured by DuPont, and also to expose a portion of an interior lining 14. The interior lining 14 of the coat 10 is adapted to hold and allow access to an electronic circuit housing 16 from inside the coat 10. The positioning of the electronic circuit housing 16 inside the coat 10 allows the electronic temperature sensing circuitry within the electronic circuit housing 16 to be insulated from the high ambient and radiant heat typically experienced during fire fighting. This location also helps to protect the electronic temperature sensing circuitry within the housing 16 from damage caused by falling debris and also protects against snagging of the housing 16 on an obstruction and prevents the compromise of the firefighter's movement.

The coat 10 illustrated in FIG. 1 also includes four temperature sensors. The first two temperature sensors, illustrated by dashed lines 17*a* and 17*b*, are shown on the fight shoulder portion of the coat, while the remaining two sensors, illustrated by dashed lines 18*a* and 18*b*, are shown on the left shoulder portion of the coat. The four temperature sensors 17*a*, 17*b*, 18*a* and 18*b* are positioned between the insulative lining 14 and the exterior heat resistant shell 12. This positioning permits the sensors to measure the impact of the surrounding environment on the heat resistant shell 12. Well known thermistors and polymeric thin film RTD type temperature sensors have been found to perform adequately as temperature sensors for the purposes of the present invention. While only one temperature sensor is necessary to practice the present invention, the plurality of sensors illustrated provides flexibility to configure the temperature sensing circuit for redundancy or to configure the circuit to indicate different degrees of danger or a combination of both as will be further described below. Also, the temperature sensors may be located at places on the garment other than the shoulder portion without deviating from the scope of the present invention.

The protective garment 10 of the present invention further includes a first speaker 20 and a second speaker, illustrated by the dashed lines 22, positioned on the inside surface of a high necked collar 24 so as to be aimed directly at a wearer's ears when the collar 24 is held closed by a closure means 26*a* and 26*b*, such as Velcro hook-and-loop area fasteners. Preferably, speakers 20 and 22 are piezo electric type speakers because piezo electric type speakers provide adequate sound pressure levels of 90 dB at 20 cm sufficient to alert a wearer in a noisy environment. Those skilled in the art should appreciate that speakers 20 and 22 can be located on other parts of the coat 10 without deviating from the scope of the present invention.

Also, a plurality of electrical conductors are positioned between the exterior heat resistant shell 12 and the interior lining 14 of the coat 10. As will be further described below, the electrical conductors illustrated in FIG. 1 include four conductors, 19*a*, 19*b*, 21*a*, and 21*b* which connect the temperature sensors 17*a*, 17*b*, 18*a*, and 18*b* to a electronic temperature sensing circuit (not shown) housed within the electronic temperature sensing circuit housing 16. Two conductors 23*a* and 23*b* connect speakers 20 and 22 to the electronic temperature sensing circuit.

Figure 2:
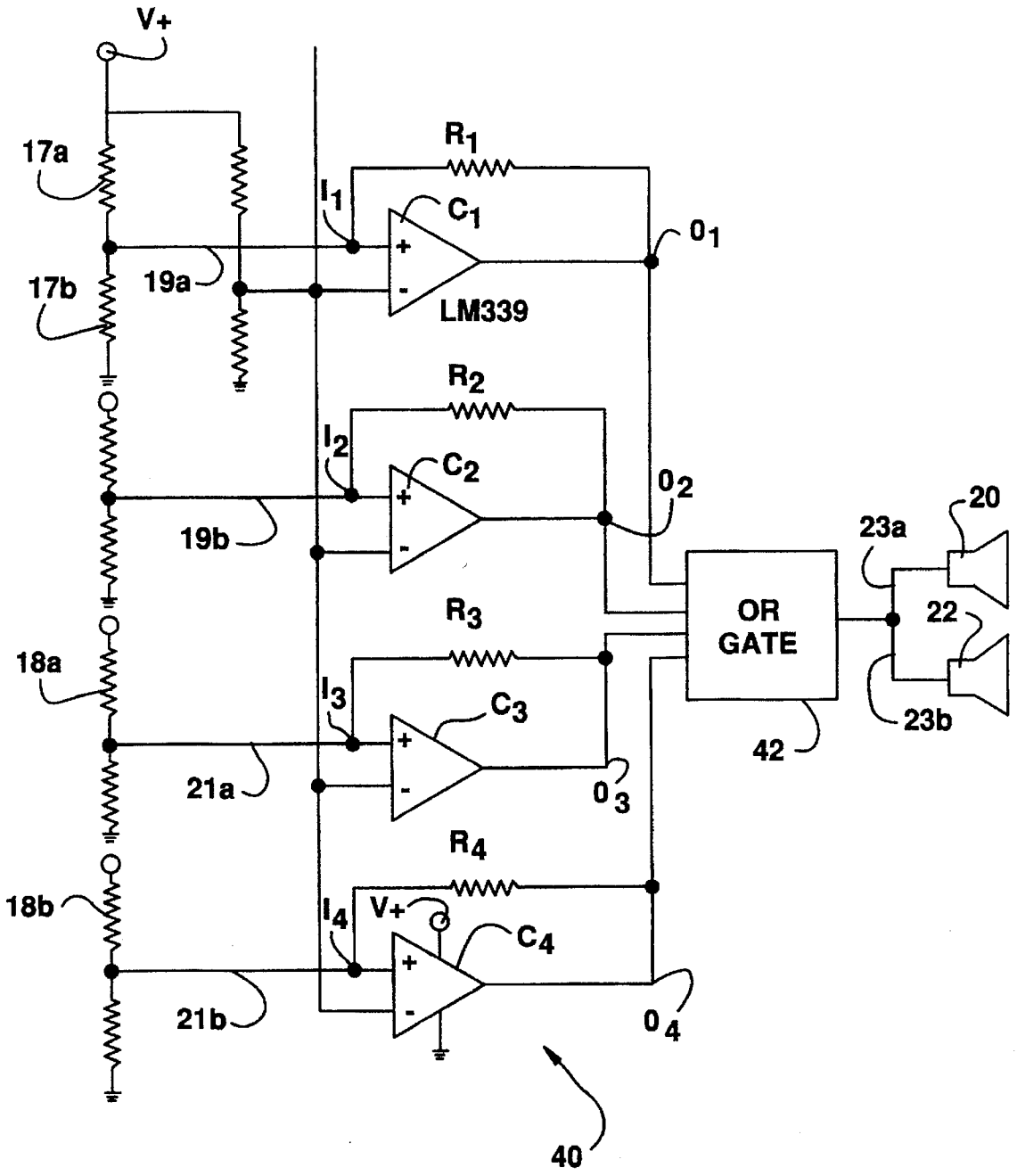
FIG. 2 is a schematic diagram of a logic circuit for temperature monitoring circuit incorporated into the protective garment of the present invention.

FIG. 2 illustrates a schematic diagram of a four channel logic circuit 40 used in the present invention as the electronic temperature sensing circuit to determine whether the protective garment wearer is potentially entering a dangerous high temperature condition. As described above, the logic circuit 40 may be housed in electronic circuit housing 16. At the heart of the logic circuit 40 are four comparators C1, C2, C3, and C4. LM339 type comparators have been found to perform satisfactorily for the purposes of the present invention. Comparator C1 includes an input I1 which is electrically connected to temperature sensor 17*a* via electrical conductor 19*a*. Comparator C1 also includes an output O1 which is electrically connected to an OR gate 42. As FIG. 2 illustrates, the remaining comparators are electrically interconnected in a similar manner between the remaining temperature sensors and the OR gate 42. The threshold of each of the comparators are set to predetermined values which depend upon the desired threshold temperatures to be sensed by each of the temperature sensors 17*a*, 17*b*, 18*a*, and 18*b*. When an input of a comparator exceeds a predetermined threshold, that comparator sends a signal through its output to the OR gate 42. The OR gate 42 causes a signal to be sent along conductors 23*a* and 23*b* to sound speakers 20 and 22. The sounding of the speakers 20 and 22 alerts the wearer that the temperature of the exterior heat resistant shell 12 of coat 10 has exceeded a predetermined temperature.

A "Quad" board manufactured by Advanced Temperature Devices, Inc. has been found to perform adequately as logic circuit 40 for the purposes of the present invention by providing up to four interconnectable comparator circuits such as those illustrated in FIG. 2.

FIG. 2 illustrates one embodiment of the present invention where the thresholds of comparators C1–C4 of logic circuit 40 are set to respond to the same predetermined temperature level so as to provide quadruple redundancy. In another embodiment, the thresholds of comparators C1–C4 may be configured so as to have different thresholds and the outputs of comparators C1–C4 may be connected to many different combinations of logic components such as AND gates or OR gates in a well known manner so as to permit indication to the wearer that the exterior heat resistant shell 12 has exceeded more than one predetermined temperature threshold. While several preferred embodiments of the present invention have been described, it should be understood that the preferred embodiment is capable of variation, addition, omission, and modification without departing from the spirit and scope of the invention.

Thus, what has been described is a protective garment having a temperature monitoring circuit incorporated therein so as to provide a wearer with an audible warning of the temperature of the exterior heat resistant shell. The invention as described above admirably achieves the objects of the invention; however, it will be appreciated that departures can be made by those skilled in the art without departing from the spirit and scope of the invention, which is deemed limited only by the appended claims and the reasonable interpretation thereof.

What is claimed is:

1. A firefighting turnout coat comprising a body portion adapted to enclose the torso of a firefighter and a pair of arms extending from the body portion, each of the body portion and the arms being formed of a heat resistant fabric exterior shell, an interior lining within the body portion and the arms; an electronic temperature sensing circuit positioned between the shell and the interior lining, the interior temperature sensing circuit including an input, an output and a logic circuit operatively connected to the input and output and being operative to determine whether a signal at the input has exceeded a predetermined limit and to cause a signal to be sent to the output when the signal at the input has exceeded the predetermined limit; an electronic temperature sensor positioned between the shell and the interior lining and connected to the input of the electronic temperature sensing circuit; and at least one audible alerting means fixed to the coat, said audible alerting means being electrically connected to the output of the electronic temperature sensing circuit and operative to generate an audible signal when the signal at the input has exceeded the predetermined limit.

2. The coat of claim 1, wherein the temperature sensor is a thermistor and the audible alerting means is a piezo electric speaker.

3. A firefighting coat comprising a body portion adapted to enclose the torso of a firefighter and a pair of arms extending from the body portion, each of the body portion and the arms being formed of a heat resistant fabric exterior shell, an interior lining within the body portion and the arms; an electronic temperature sensing circuit including a temperature sensor positioned between the shell and the interior lining and a signal generator, said generator being operative to generate a signal to the wearer to warn the wearer of the coat of exposure to a potentially dangerously high temperature detected between the shell and the liner by the sensor.

4. A coat as defined in claim 3 wherein the body portion includes a shoulder portion and the temperature sensor is positioned in the shoulder portion.

5. The coat as defined in claim 4 wherein the coat includes a collar, and the signal generator is fixed to said collar.

6. A coat as defined in claim 4 wherein the signal generator is a signal generator providing an audible signal.

7. A coat as defined in claim 6 wherein the signal generator is a piezo electric speaker.

8. A coat as defined in claim 4 wherein the temperature sensor is a thermistor.

9. A firefighting garment comprising a body portion adapted to enclose the torso of the firefighter and a pair of arms extending from the body portion, each of the body portion and the arms being formed of a heat resistant fabric exterior shell, an interior lining within the body portion and the arms; an electronic temperature sensing circuit including a temperature sensor positioned between the shell and the interior lining and a signal generator, said generator being operative to generate a signal to the wearer to warn the wearer of the coat of exposure to a potentially dangerously high temperature detected between the shell and the liner by the sensor.

10. A firefighting turnout coat comprising a body portion adapted to enclose the torso of a firefighter and a pair of arms extending from the body portion, each of the body portion and the arms being formed of a heat resistant fabric exterior shell, an interior lining within the body portion and the arms; an electronic temperature sensing circuit positioned between the shell and the interior lining, the interior temperature sensing circuit including an input, an output and a logic circuit operatively connected to the input and output and being operative to determine whether a signal at the input has exceeded a predetermined limit and to cause a signal to be sent to the output when the signal at the input has exceeded the predetermined limit; an electronic temperature sensor positioned between the shell and the interior lining and connected to the input of the electronic temperature sensing circuit; and at least one audible alerting means fixed to the coat, said audible alerting means being electrically connected to the output of the electronic temperature sensing circuit and operative to generate an audible signal when the signal at the input has exceeded the predetermined limit.

* * * * *